US009239562B2

(12) United States Patent
Souda et al.

(10) Patent No.: US 9,239,562 B2
(45) Date of Patent: Jan. 19, 2016

(54) IMAGE FORMING APPARATUS

(71) Applicants: Makoto Souda, Nagoya (JP); Hirotaka Mori, Nagoya (JP); Shougo Sato, Seto (JP)

(72) Inventors: Makoto Souda, Nagoya (JP); Hirotaka Mori, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 13/621,481

(22) Filed: Sep. 17, 2012

(65) Prior Publication Data

US 2013/0170857 A1 Jul. 4, 2013

(30) Foreign Application Priority Data

Dec. 28, 2011 (JP) ..... 2011-288488

(51) Int. Cl.
*G03G 15/00* (2006.01)
*G03G 21/16* (2006.01)
*G03G 15/01* (2006.01)

(52) U.S. Cl.
CPC ..... *G03G 21/1647* (2013.01); *G03G 15/0189* (2013.01); *G03G 21/1623* (2013.01)

(58) Field of Classification Search
CPC ..... G03G 21/1623; G03G 21/1647
USPC ..... 399/107, 116
See application file for complete search history.

(56) References Cited

U.S. PATENT DOCUMENTS 7,821,681 B2 10/2010 Matsumoto
7,894,743 B2 2/2011 Tomatsu
8,699,911 B2 4/2014 Kaneko
2004/0101328 A1* 5/2004 Kimura et al. ..... 399/111
2008/0002341 A1 1/2008 Tomatsu
2008/0003015 A1* 1/2008 Tomatsu ..... 399/110
2008/0068680 A1 3/2008 Matsumoto
2009/0116869 A1 5/2009 Kotsuka et al.
2009/0142092 A1* 6/2009 Sato ..... 399/111
2009/0290904 A1* 11/2009 Kawai et al. ..... 399/111

(Continued)

FOREIGN PATENT DOCUMENTS

JP 54-107339 8/1979
JP 62050771 A * 3/1987 ..... G03G 15/00

(Continued)

OTHER PUBLICATIONS

Sep. 8, 2015—(JP) Notice of Reasons for Rejection—App 2011-288488.

*Primary Examiner* — David Gray
*Assistant Examiner* — Thomas Giampaolo, II
(74) *Attorney, Agent, or Firm* — Banner & Witcoff, Ltd.

(57) ABSTRACT

An image forming apparatus includes a plurality of photosensitive drums, a frame member, a first sheet metal member, and a pressing member. The frame member is configured to accommodate the photosensitive drums such that the photosensitive drums are withdrawn along an axial direction thereof. The first sheet metal member is disposed on a first side of the frame member and configured to position the photosensitive drums. The pressing member is configured to press the photosensitive drums toward the first sheet metal member. The frame member includes a first wall disposed on a second side, opposite to the first side, of the frame member in the axial direction, a second wall disposed on a third side of the frame member and connected to the first wall, and a third wall disposed on an upper side relative to the photosensitive drums and connected to the first wall and the second wall.

16 Claims, 8 Drawing Sheets

(56) References Cited

U.S. PATENT DOCUMENTS

| | | | | |
|---|---|---|---|---|
| 2010/0111562 | A1* | 5/2010 | Okabe et al. | 399/112 |
| 2010/0209140 | A1* | 8/2010 | Kamimura et al. | 399/111 |
| 2011/0188887 | A1 | 8/2011 | Kaneko | |

FOREIGN PATENT DOCUMENTS

| | | | |
|---|---|---|---|
| JP | 08-262827 | A | 10/1996 |
| JP | 09-304985 | A | 11/1997 |
| JP | 11-258885 | A | 9/1999 |
| JP | 2004-029606 | A | 1/2004 |
| JP | 2006-239876 | A | 9/2006 |
| JP | 2007-199154 | A | 8/2007 |
| JP | 2008-009262 | A | 1/2008 |
| JP | 2008-070606 | | 3/2008 |
| JP | 2010-026153 | A | 2/2010 |
| JP | 2010-164993 | A | 7/2010 |
| JP | 2010-204354 | A | 9/2010 |
| JP | 2011-150007 | A | 8/2011 |
| JP | 2011-158495 | A | 8/2011 |

* cited by examiner

IMAGE FORMING APPARATUS

CROSS REFERENCE TO RELATED APPLICATION

This application claims priority from Japanese Patent Application No. 2011-288488, filed on Dec. 28, 2011, the entire subject matter of which is incorporated herein by reference.

FIELD

Aspects of the disclosure relate to an electrophotographic image forming apparatus.

BACKGROUND

A known electrophotographic image forming apparatus includes a main body casing, and process cartridges detachably attachable to the main body casing.

In the above image forming apparatus, the main body casing includes a pair of left and right frames made of resin, a pair of left and right metal frames fixed to inner surfaces of the left and right frames made of resin, and four pipes extending between the metal frames. The process cartridges each include a photosensitive drum extending in the left and right direction. The process cartridges are disposed between the pair of petal frames when attached to the main body casing.

In the image forming apparatus, to maintain the rigidity in the main body frame, the process cartridges are detachably attachable to the main body casing in substantially a top-bottom direction (which is a direction perpendicular to an axial direction of the photosensitive drum). In this configuration, it is difficult to detachably attach the process cartridges relative to the frame member along an axial direction of the process cartridges.

SUMMARY

Illustrative aspects of the disclosure provide an image forming apparatus including a frame member maintaining its rigidity and configured to allow photosensitive drums to be withdrawn relative to the frame member along an axial direction of the photosensitive drums.

According to an aspect of the disclosure, an image forming apparatus includes a plurality of photosensitive drums, a frame member, a sheet metal member, and a pressing member. The photosensitive drums are spaced apart from each other and arranged such that axes of the photosensitive drums are parallel relative to each other in an arrangement direction perpendicular to an axial direction of the photosensitive drums. The frame member is configured to accommodate the photosensitive drums such that the photosensitive drums are withdrawn along the axial direction. The first sheet metal member is disposed on a first side of the frame member and configured to position the photosensitive drums. The pressing member is configured to press the photosensitive drums toward the first sheet metal member. The frame member includes a first wall, a second wall, and a third wall. The first wall is disposed on a second side, opposite to the first side, of the frame member in the axial direction. The second wall is disposed on a third side of the frame member, the third side is connected to the first side and the second side, and the second wall is connected to the first wall. The third wall is disposed on an upper side relative to the photosensitive drums, and the third wall is connected to the first wall and the second wall.

BRIEF DESCRIPTION OF THE DRAWINGS

Illustrative aspects will be described in detail reference to the following figures in which like elements are labeled with like numbers and in which.

DETAILED DESCRIPTION

A first illustrative embodiment will be described in detail with reference to the accompanying drawings.

Figure 1:
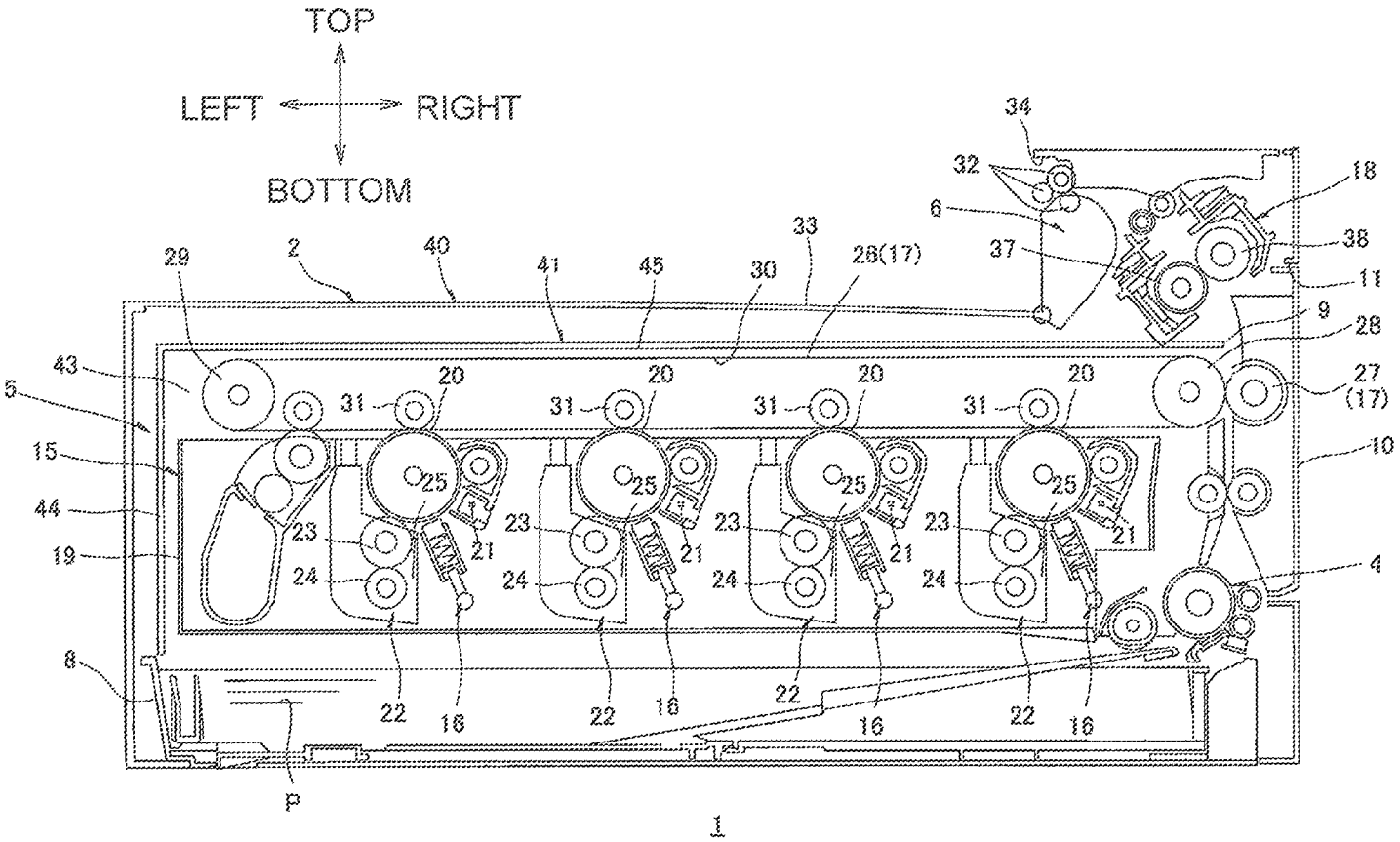
FIG. 1 is a side sectional view of an illustrative image forming apparatus, e.g. a printer, according to a first embodiment of the disclosure.
Figure 2:
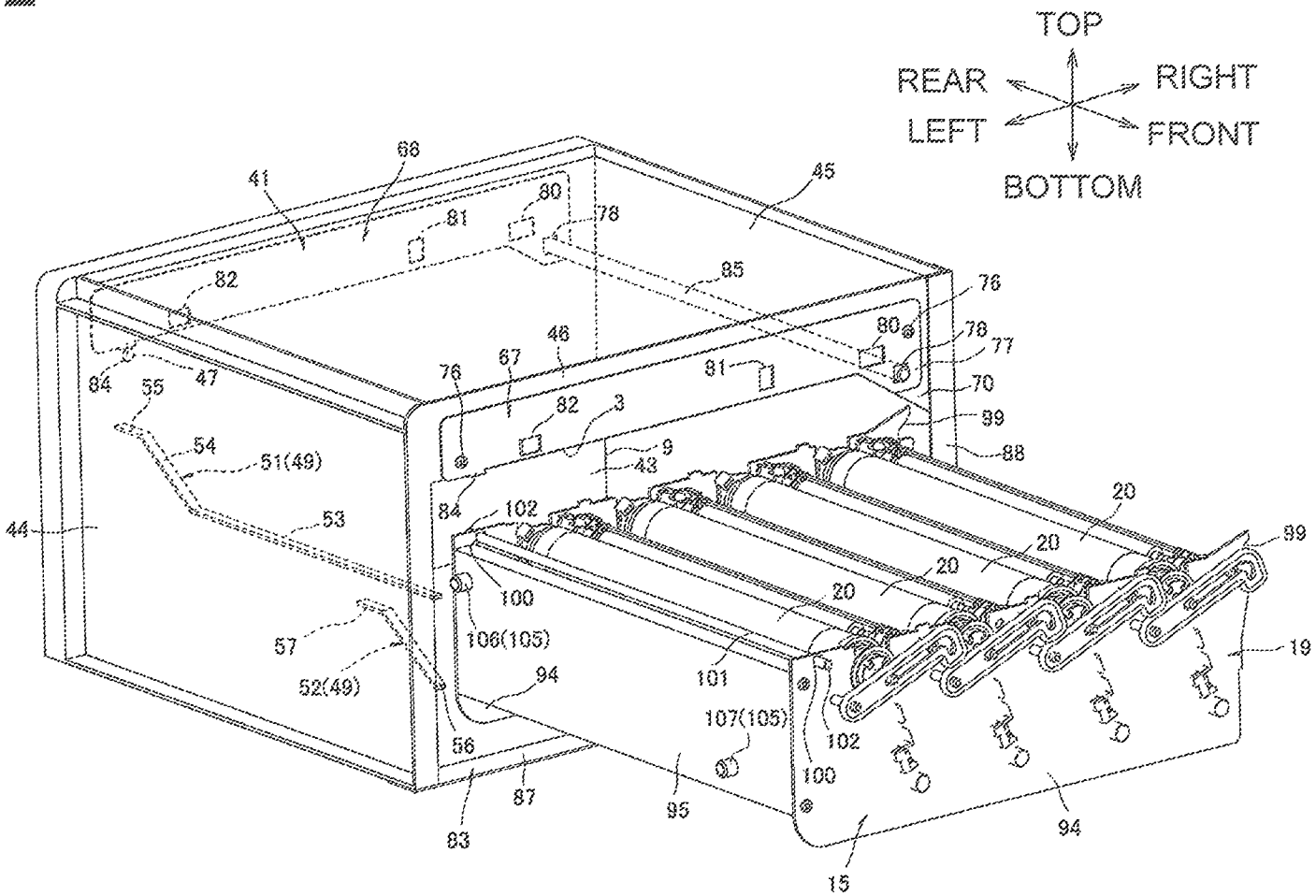
FIG. 2 is a perspective view, looking from the front and top, of the printer illustrated in FIG. 1 from which a process unit is withdrawn.

As shown in FIGS. 1 and 2, an image forming apparatus according to aspects of the invention applies to a printer 1, which is a color printer of an intermediate transfer type.

As shown in FIG. 1, the printer 1 includes, in a main body casing 2, a sheet supply section 4 configured to supply a recording medium, e.g., a sheet P, an image forming section 5 configured to form an image on the sheet P supplied from the sheet supply section 4, and a sheet ejection section 6 configured to eject the sheet P having the image.

The main body casing 2 is box-shaped. As shown in FIG. 2, one side wall of the casing 2 contains an opening 3.

In the following descriptions, the top or upper side, the bottom or lower side, the left or left side, the right or right side, the front or front side, and the rear or rear side are used to define the various parts when the printer 1 is disposed in an orientation in which it is intended to be used In this embodiment, the side on which the opening 3 is provided is referred to as the front or front side, and the opposite side is referred to as the rear or rear side. The left or left side and the right or right side are defined when the printer 1 is viewed from the front side.

As shown in FIG. 1, the sheet supply section 4 includes a sheet supply tray 8 configured to store stack of sheets P therein. The sheet supply tray 8 is disposed in a bottom portion of the main body casing 2 and non-destructively detachable from and attachable to the main body casing 2.

The sheets P in the sheet supply tray 8 are separated one by one and supplied to the image forming section 5 (specifically, between an intermediate transfer belt 30 and a secondary transfer roller 27) at a specified time.

The image forming section 5 is disposed above the sheet supply section 4, and includes a process unit 15, a transfer unit 17, and a fixing unit 18.

The process unit 15 is disposed facing the sheet supply tray 8 from above, and includes photosensitive drums 20, scorotron chargers 21, and developing units 22, and LED units 16.

There are, for example, four photosensitive drums 20 for four different colors of black, yellow, magenta, and cyan, which are spaced apart from each other in the left-right direction and arranged such that their axes are parallel relative to each other and perpendicular to the left-right direction.

As shown in FIG. 2, each of the photosensitive drums 20 has substantially a cylindrical shape, which extends in the front-rear direction, and is rotatably supported at upper ends of the process unit 15 such that each of the photosensitive drums 20 is exposed from above.

As shown in FIG. 1, there are four scorotron chargers 21 corresponding to the photosensitive drums 20. Each of the scorotron chargers 21 is disposed at the right of and spaced apart from a corresponding one of the photosensitive drums 20.

There are four developing units 22 corresponding to the photosensitive drums 20. Each of the developing units 22 is disposed facing a corresponding one of the photosensitive drums 20 from below. Each of the developing units 22 includes a developing roller 23.

Each developing roller 23 is rotatably supported in an upper end of a corresponding developing unit 22 such that the developing roller 23 is exposed from above and contacts a corresponding photosensitive drum 20 from below.

Each developing unit 22 includes a supply roller 24 configured to supply toner to the developing roller 23, and a layer-thickness regulating blade 25 configured to regulate a thickness of toner supplied to the developing roller 23. Each developing unit 22 contains a developer, e.g. toner of one color.

There are four LED units 16 corresponding to the photosensitive drums 20. Each of the LED units 16 is disposed at a small distance on a lower right side of a corresponding photosensitive drum 20 such that it faces the corresponding photosensitive drum 20 from below. Each LED unit 16 is configured to expose a surface of its corresponding photosensitive drum 20 based on image data and form a latent image on the surface.

The transfer unit 17 includes a belt unit 26 and a secondary transfer roller 27.

The belt unit 26 is disposed above the photosensitive drums 20 along the left-right direction so as to face the photosensitive drums 20 from above.

The belt unit 26 includes a drive roller 28, a driven roller 29, an endless belt, e.g. an intermediate transfer belt 30, and four primary transfer rollers 31.

The drive roller 28 and the driven roller 29 are spaced apart from each other in the left-right direction.

The intermediate transfer belt 30 is looped around the drive roller 28 and the driven roller 29 and disposed such that a lower side of the intermediate transfer belt 30 contacts the photosensitive drums 20. In other words, the intermediate transfer belt 30 is disposed along the left-right direction.

The intermediate transfer belt 30 is configured to rotate upon rotation of the drive roller 28 in such a direction that the lower side contacting the photosensitive drums 20 moves from left to right.

The primary transfer rollers 31 are disposed within the intermediate transfer belt 30 and above the respective photosensitive drums 20 such that the lower side of the intermediate transfer belt 30 is sandwiched between the primary transfer rollers 31 and the photosensitive drums 20.

The secondary transfer roller 27 is disposed opposite to the drive roller 28 of the belt unit 26 (the right end portion of the belt unit 26) with the intermediate transfer belt 30 interposed therebetween.

The fixing unit 18 is disposed above the secondary transfer roller 27, and includes a heat roller 37 and a pressure roller 38 disposed facing the heat roller 37.

In each developing unit 22, toner is supplied to the supply roller 24 and then supplied from the supply roller 24 to the developing roller 23.

Toner supplied to the developing roller 23 is positively charged between the supply roller 24 and the developing roller 23 by friction with rotation of the developing roller 23, regulated to a specified thickness by the layer-thickness regulating blade 25 and then carried on a surface of the developing roller 23 as a thin layer.

The surface of the photosensitive drum 20 is uniformly and positively charged by the scorotron charger 21 along with rotation of the photosensitive drum 20, and then exposed by the LED unit 16. Thus, a latent image corresponding to an image to be formed on a sheet P is formed on the surface of the photosensitive drum 20.

When the photosensitive drum 20 further rotates, the toner carried on the surface of the developing roller 23 is supplied to the latent image formed on the surface of the photosensitive drum 20. With this, the latent image on the photosensitive drum 20 is visualized into a toner image, which is carried on the surface of the photosensitive drum 20 by reversal developing. In this manner, toner images are earned on the surfaces of the respective photosensitive drums 20.

The toner images carried on the surfaces of the respective photosensitive drums 20 by reversal developing are primarily transferred to the lower side of the intermediate transfer belt 30 moving from the left to the right. At this time, the toner images are sequentially overlapped one over the other to form a toner image on the intermediate transfer belt 30.

The toner image formed on the intermediate transfer belt 30 is secondarily transferred to a sheet P supplied from the sheet supply section 4 when the toner image formed on the intermediate transfer belt 30 passes a position where the toner image faces the secondary transfer roller 27.

The toner image transferred to the sheet P is thermally fixed at the fixing unit 18 while the sheet P passes between the heat roller 37 and the pressure roller 38.

An upper surface of the casing 2 contains an ejection tray 33 to which the sheet P is to be ejected. The sheet ejection section 6 is disposed at an upper right end portion of the casing 2 and protrudes upward more than the ejection tray 33.

The sheet ejection section 6 has an ejection opening 34 formed above the ejection tray 33. The sheet P is to be ejected from the ejection opening 34. The sheet ejection section 6 includes a plurality of, e.g., three, ejection rollers 32, which are disposed in the ejection opening 34 and configured to feed the sheet P to the ejection tray 33.

The sheet P having the toner image fixed at the fixing unit 18 is ejected onto the ejection tray 33 by the ejection rollers 32.

As shown in FIG. 1, the main body casing 2 includes an outside casing 40 constituting an outer shape of the printer 1 and an inside casing 41, as an example of a frame member, which is disposed inside the outside casing 40.

The outside casing 40 is shaped like a rectangular box as viewed from a side, and its right sidewall has an opening 11. The outside casing 40 includes a side cover 10 configured to move, e.g., pivot around its lower end, between a close position to close the opening 11 and an open position to open the opening 11. The outside casing 40 supports the secondary transfer roller 27 rotatably.

When the side cover 10 is in the open position, rollers in the sheet supply section 4 (defining a sheet conveyance path where a sheet P is conveyed) are exposed from the right side via a jam opening 9 and the opening 11. Thus, if a sheet P is jammed at any roller in the sheet supply section 4, the jammed sheet P can be easily removed by opening the side cover 10.

The inside casing 41 is shaped like a rectangular box as viewed from a side, as shown in FIG. 2. The inside casing 41 has a top-bottom dimension and a left-right dimension sufficient to accommodate the sheet supply section 4 and the image forming section 5 (except for the secondary transfer roller 27, hereinafter the same). The inside casing 41 is accommodated in the outside casing 40 such that the inside easing 41 is left-aligned to provide a space on the right side for placing the side cover 10 on the right side of the outside easing 40.

As shown in FIG. 2, the inside casing 41 integrally includes a rear 43 as an example of a first wall, a left wall 44 as an example of a second wall, an upper wall 45 as an example of a third wall, and a sheet metal fixing wall 46 as an example of a resin-trade frame.

Figure 3:
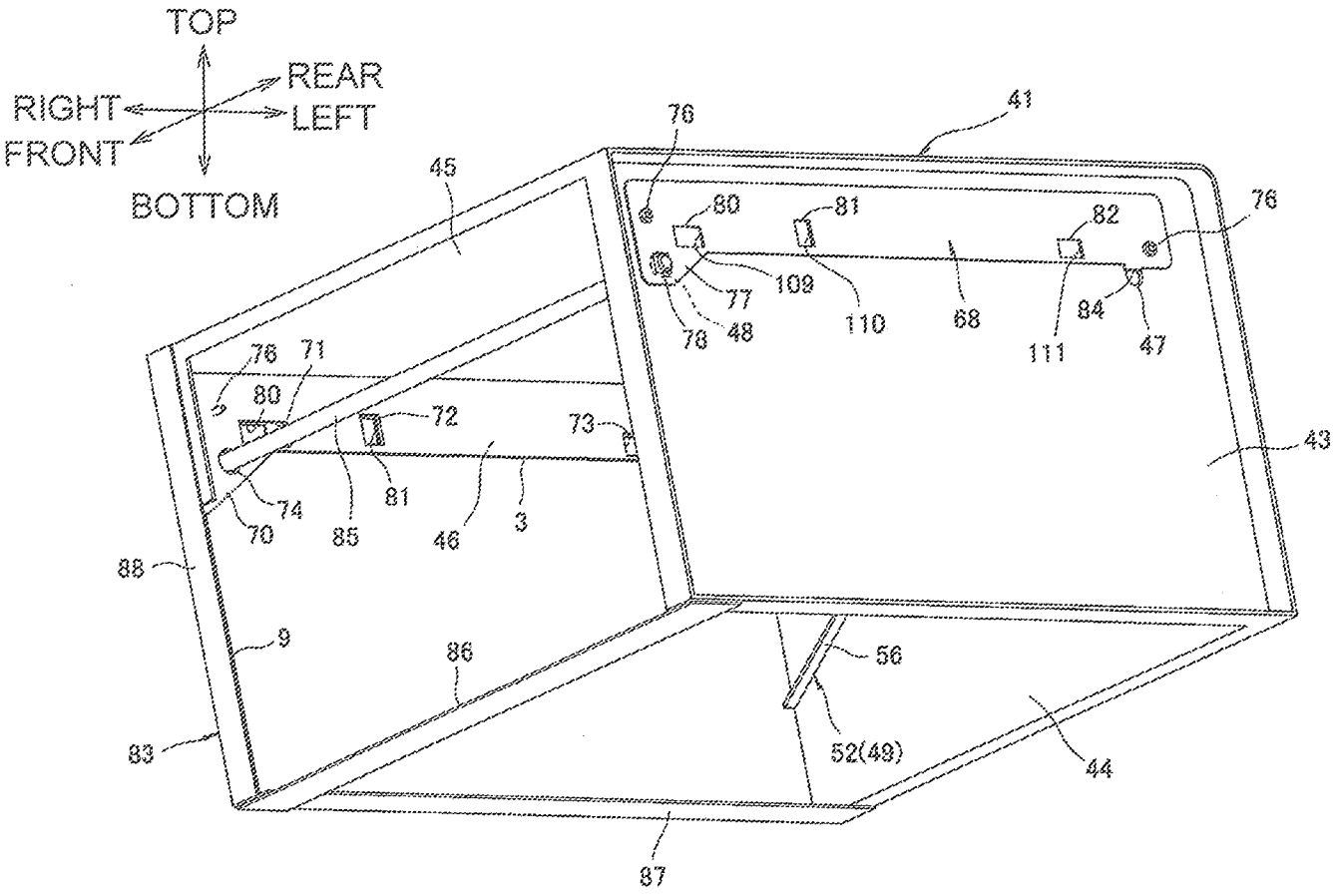
FIG. 3 is a perspective view, looking from the bottom and acid rear, of an inside casing illustrated in FIG. 2.

As shown in FIG. 3, the rear wall 43 is formed like a flat plate having a rectangular shape as viewed from the rear side. The rear wall 43 is made of resin.

The rear wall 43 has a first reference shaft hole 48 in which a rear end portion of a reference shaft 85 engages, a first opening 109 in which a rear-side bearing portion 91 engages, a second opening 110 in which a rear-side first positioning protrusion 92 engages, a third opening 111 in which a rear-side second positioning protrusion 93 engages, and an engagement shaft hole 47 in which a rear end portion of an engagement shaft 101 engages.

The first reference shaft hole 48 is formed through a right end portion in an upper portion of the rear wail 43, and has substantially a circular shape as viewed from the rear side. The first reference shaft hole 48 has a diameter greater than an outside diameter of the reference shaft 85.

The first opening 109 is formed through the rear wall 43 in an upper left portion of the first reference shaft hole 48, and has substantially a rectangular shape as viewed from the rear side.

The second opening 110 is formed through the rear wall 43 on the left side of the first opening 109, and has substantially a rectangular shape as viewed from the rear side.

The third opening 111 is formed through the rear wall 43 on the left side of the second opening 110, and has substantially a rectangular shape as viewed from the rear side, The engagement shaft hole 47 is formed through the rear wall 43 in a lower left portion of the third opening 111. The engagement shaft hole 47 has a diameter greater than an outside diameter of the engagement shaft 101.

As shown in FIG. 2, the left wall 44 is made of resin, formed like a flat plate and extends frontward from a left end portion of the rear wall 43.

A right surface of the left wall 44 includes a guide portion 49 and a first pressing member 50 (FIG. 5B) as an example of a pressing member.

The guide portion 49 includes an upper guide portion 51 and a lower guide portion 52.

The upper guide portion 51 is disposed in a vertical central portion of the left wall 44 and formed like a flat plate protruding rightward from the right surface of the left wall 44. The upper guide portion 51 integrally includes a horizontal portion 53, an inclined portion 54 as an example of a second guide portion, and an upper spring support portion 55.

The horizontal portion 53 extends rearward from a front end of the left wall 44.

The inclined portion 54 continues from a rear end portion of the horizontal portion 53 and is inclined upward toward the rear side.

The upper spring support portion 55 continues from a rear end portion of the inclined portion 54 and extends rearward.

The lower guide portion 52 is disposed below the upper guide portion 51 and is shaped like a flat plate protruding rightward from the right surface of the left wall 44. The lower guide portion 52 includes an inclined portion 56 as an example of a second guide portion and a lower spring support portion 57.

The inclined portion 56 is inclined upward from the front end portion of the left wall 44 toward the rear side thereof The inclined portion 56 has a front-rear dimension and a top-bottom dimension, which are substantially equal to those of the inclined portion 54 of the upper guide portion 51.

The lower spring support portion 57 continues from a rear end portion of the inclined portion 56 and extends rearward.

Figure 6:
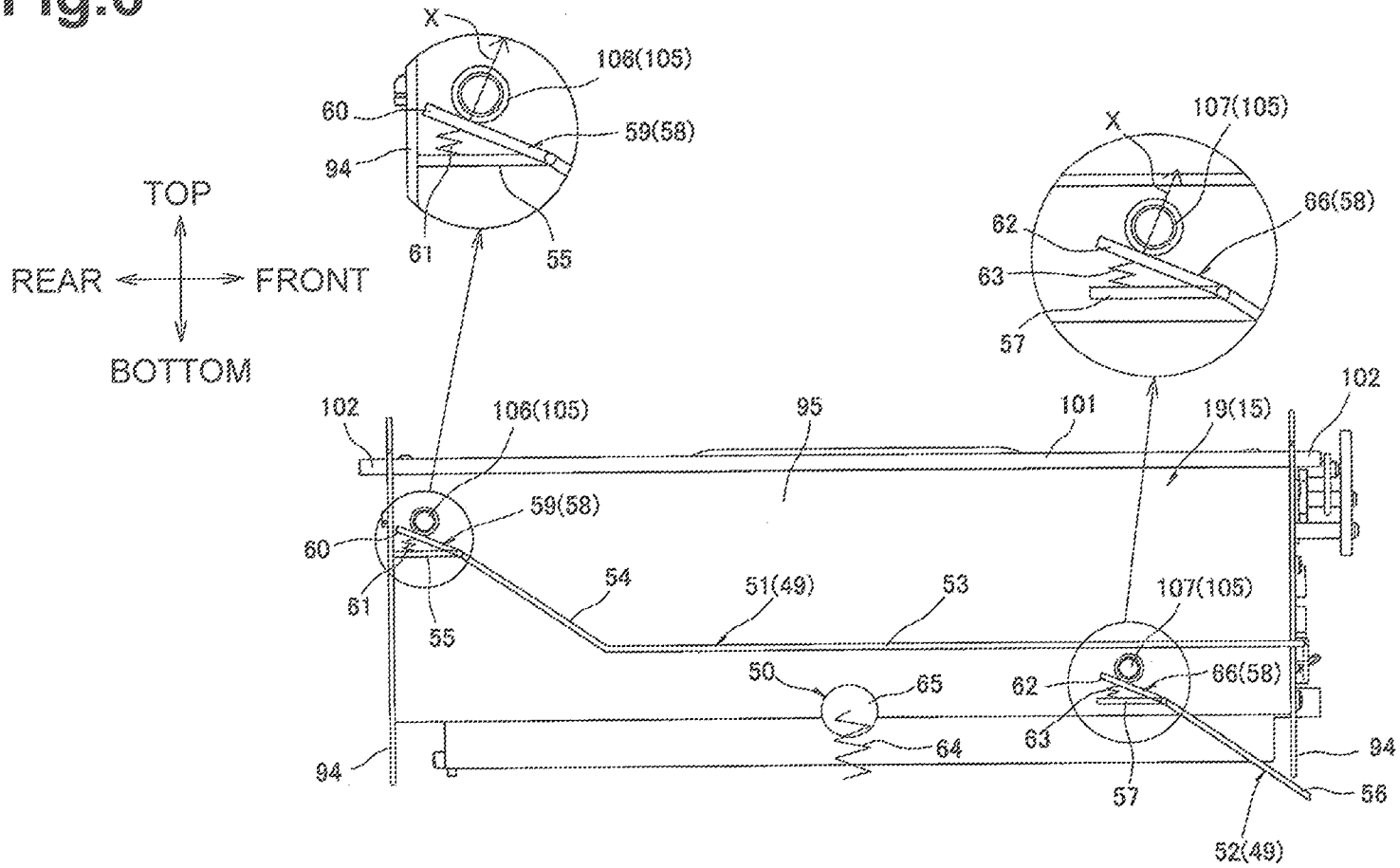
FIG. 6 is a side sectional view of the printer illustrated in FIG. 5, where the process unit is accommodated.

As shown in FIG. 6, the guide portion 49 includes a second pressing member 58 as an example of a pressing member.

The second pressing member 58 includes an upper pressing portion 59 corresponding to the upper guide portion 51 and a lower pressing portion 66 corresponding to the lower guide portion 52.

The upper pressing portion 59 is disposed on an upper surface of the upper spring support portion 55 of the upper guide portion 51, and includes an upper pivotable portion 60 and a coil spring 61.

The upper pivotal portion 60 is shaped like a flat plate, and is disposed such that the upper pivotable portion 60 is pivotable about its front end portion relative to the upper spring support portion 55.

The coil spring 61 is interposed between the rear end portion of the upper spring support portion 55 and the upper pivotable portion 60 such that the coil spring 61 expands and contracts vertically.

With this configuration, the upper pivotable portion 60 is urged upward (specifically, clockwise direction as viewed from a rear side) and is inclined upward toward the rear side under normal conditions.

The lower pressing portion 66 is disposed on an upper surface of the lower spring support portion 57 of the lower guide portion 52, and includes a lower pivotable portion 62 as an example of a first guide portion and a coil spring 63.

The lower pivotable portion 62 is shaped like a flat plate, and is disposed such that the lower pivotable portion 62 is pivotable about its front end portion relative to the lower spring support portion 57.

The coil spring 63 is interposed between the rear end portion of the horizontal portion 63 and the rear end portion of the lower pivotable portion 62 such that the coil spring 63 expands and contracts vertically.

With this configuration, the lower pivotable portion 62 is urged upward (specifically, in a clockwise direction as viewed from a rear side) and is inclined upward toward the rear side.

Figures 5A, 5B:
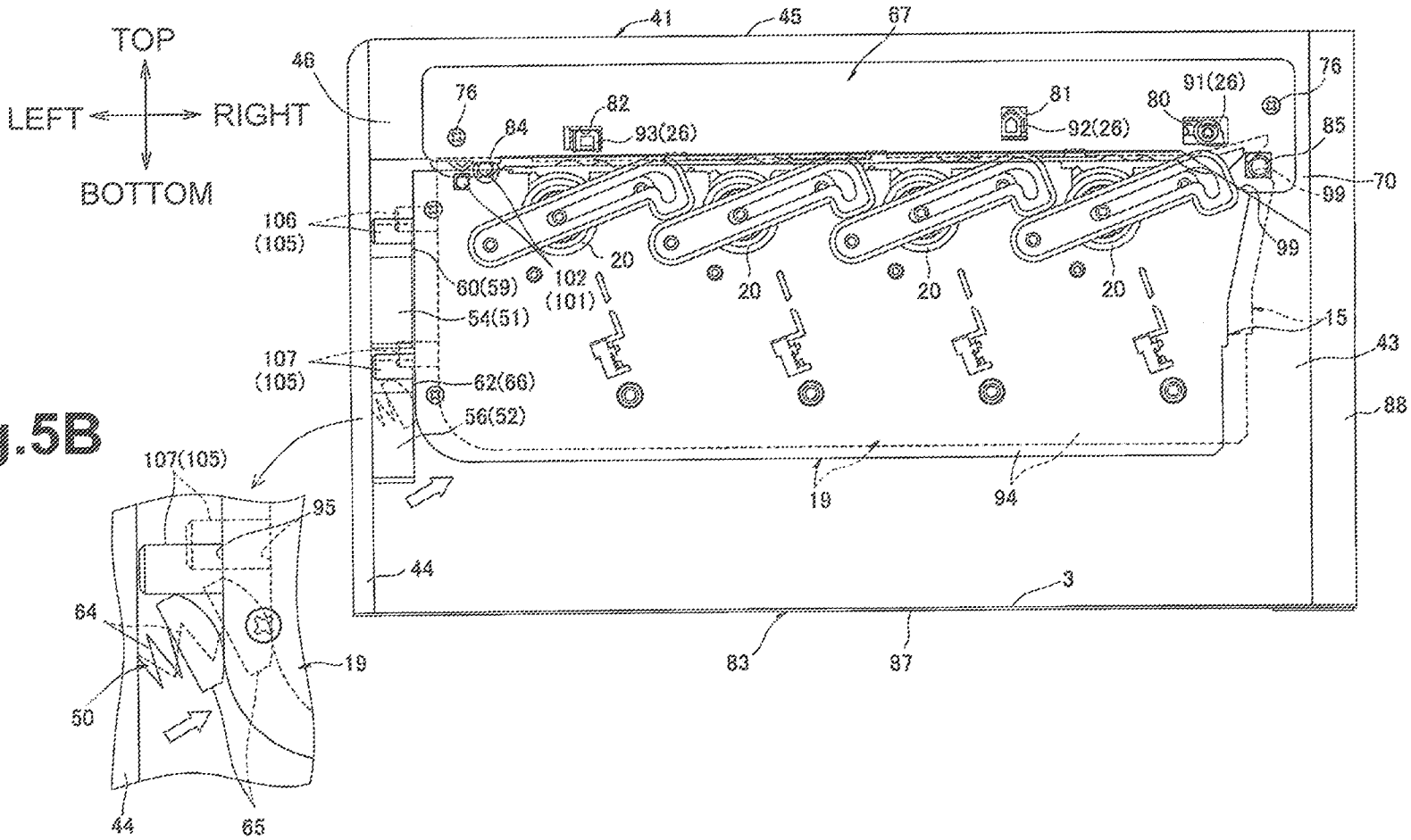
FIG. 5A and 5B are front views of the printer illustrated in FIG. 1, where the process unit is accommodated.

As shown in FIG. 5A and 5B, the first pressing member 50 is disposed in a central portion of the left wall 44 (FIG. 6) in the front-rear direction such as to correspond to a lower end portion of a left sidewall 95 of a drawer frame 19. The first pressing member 50 includes an urging member 64 and a contact portion 65.

As shown in FIG. 513, the urging member 64 is shaped like a coil spring and a base portion of the urging member 64 is fixed to the right surface of the left wall 44 such that the urging member 64 expands and contacts in an upper right direction and a lower left direction.

The contact portion 65 is shaped like a letter D as viewed from the front side, bulging in an upper right direction, and is fixed to a free end of the urging member 64.

The first pressing member 50 is configured to move between an advance position where the contact portion 65 advances in the upper right direction and a withdrawal position where the contact portion 65 withdraws toward the lower left direction. The first pressing member 50 is located in the withdrawal position by a regulating member (not shown) under normal circumstances.

As shown in FIG. 2, the upper wall 45 is made of resin, shaped like a flat plate, and disposed such that the upper wall 45 connects upper end portions of the rear wall 43 and the left wall 44.

The sheet metal fixing wall 46 is made of resin and shaped like a flat plate. The sheet metal fixing wall 46 extends downward from a front end portion of the upper wall 45. The sheet metal fixing wall 46 has a top-bottom dimension which is about one-fifths of the top-bottom dimension of the left wall 44.

As shown in FIG. 3, the sheet metal fixing wall 46 has a first through hole 71 in which a front-side bearing portion 91 engages, a second through hole 72 in which a front-side first positioning protrusion 92 engages, and a third through hole 73 in which a front-side second positioning protrusion 93 engages.

The first through hole 71 is formed through a right end portion of the sheet metal fixing wall 46, and has substantially a rectangular shape as viewed from the rear side.

The second through hole 72 is formed through the sheet metal fixing wall 46 on the left side of the first through hole 71, and has substantially a rectangular shape as viewed from the rear side.

The third through hole 73 is formed through the sheet metal fixing wall 46 on the left side of the second through hole 72, and has substantially a rectangular shape as viewed from the rear side.

The sheet metal fixing wall 46 integrally includes an extension portion 70.

The extension portion 70 is shaped like a flat plate having substantially a triangular shape as viewed from the rear side, and extends downward from a lower end portion of a right end portion of the sheet metal fixing wall 46.

The extension portion 70 has a second reference shaft hole 74 in a central portion of the extension portion 70.

The second reference shaft hole 74 is formed to receive a front end of the reference shaft 85 and has substantially a circular shaft as viewed from the rear side. The second reference shaft hole 74 has a diameter greater than the outside diameter of the reference shaft 85.

The inside casing 41 includes a reinforcing portion 83, a first sheet metal member 67 (FIG. 2), and a second sheet metal member 68.

The reinforcing portion 83 includes a first reinforcing member 86, a second reinforcing member 87, and a third reinforcing member 88.

The first reinforcing member 86 is made of metal and shaped like a flat plate extending frontward from a right end portion of the lower end of the rear wall 43.

The second reinforcing member 87 is made of metal and shaped like a flat plate extending rightward from a front end portion of the lower end of the left wall 44.

The third reinforcing member 88 is made of metal and is substantially L-shaped as viewed from the top, as shown in FIG. 2. The third reinforcing member 88 extends vertically and an upper end portion of the third reinforcing member 88 is fixed to an L-shaped portion, as viewed from the top, which is formed by the front end portion of the right end of the upper wall 45 and the right end portion of the front end of the upper wall 45. In other words, the third reinforcing member 88 extends downward from the upper wall 45 such as to cover the right end portion of the sheet metal fixing wall 46.

As shown in FIG. 3, a front end portion of the first reinforcing member 86, a light end portion of the second reinforcing member 87, and a lower end portion of the third reinforcing member 88 are coupled.

With this coupling, the opening 3 having substantially a rectangular shape as viewed from the front side is defined by the front end portion of the left wall 44, the lower end portion of the sheet metal fixing wall 46, the second reinforcing member 87 and the third reinforcing member 88 in the front surface of the inside casing 41.

In the right surface of the inside casing 41, the jam opening 9 having a rectangular shape as viewed from the right side is defined by the right end portion of the rear wall 43, the right end portion of the upper wall 45, the first reinforcing member 86, and the third reinforcing member 88.

As shown in FIG. 2, the first sheet metal member 67 and the second sheet metal member 68 are disposed opposite to each other in the left-right direction in the upper portion of the inside casing 41, and formed from a common mold into an identical shape and size.

Thus, the following will describe the first sheet metal member 67. Those elements corresponding to elements of the first sheet metal member 67 are identified with the same numerals, and thus and the description of the second sheet metal member 68 will be omitted for the sake of brevity As shown in FIG. 2, the first sheet metal member 67 is shaped like a fiat plate elongated in the left-right direction.

Figure 4:
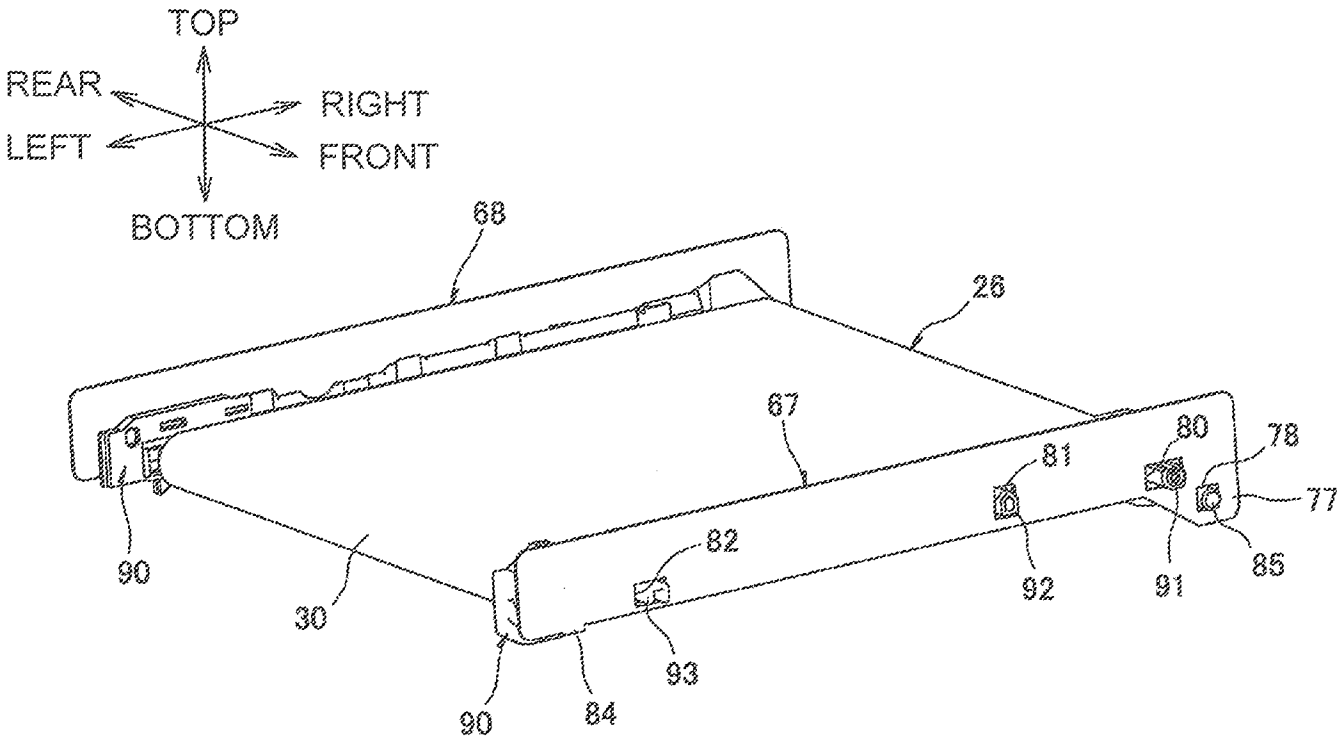
FIG. 4 is a perspective view, looking from the front and top, of a belt unit illustrated in FIG. 1.

As shown in FIG. 4, the first sheet metal member 67 has a bearing portion insertion hole 80 corresponding to the bearing portion 91, a first positioning hole 81 corresponding to the first positioning protrusion 92, and a second positioning hole 82 corresponding to the second positioning protrusion 93.

The bearing portion insertion hole 80 is formed through a rear end portion of the first sheet metal member 67 and has substantially a rectangular shape as viewed from the front side.

The first positioning hole 81 is formed through the first sheet metal member 67 on the left side of the bearing portion insertion hole 80, and has substantially a rectangular shape as viewed from the front side.

The second positioning hole 82 is formed through the first sheet metal member 67 on the left side of the first positioning hole 81, and has substantially a rectangular shape as viewed from the front side.

The first sheet metal member 67 integrally includes a contact portion 84 and a reference shaft fixing portion 77.

The contact portion 84 protrudes downward from the lower end of the left end portion of the first sheet metal member 67 and has substantially a rectangular shape as viewed from the front side.

The reference shaft fixing portion 77 has substantially a rectangular shape, as viewed from the front side, which extends downward from the lower end of the right end portion of the first sheet metal member 67. A left end portion of the reference shaft fixing portion 77 is inclined upward toward the left such as to align with the left end of the extension portion 70.

The reference shaft fixing portion 77 has a reference shaft fixing hole 78 formed through in a central portion of the reference shaft fixing portion 77. The reference shaft fixing hole 78 has substantially a rectangular shape as viewed from the front side, and has a top-bottom dimension and a left-right dimension, which are substantially equal to an outer diameter of a reference shaft 85.

As shown in FIG. 2, the first sheet metal member 67 is fixed to a front surface of the sheet metal fixing wall 46 by screws 76 such that the reference shaft fixing hole 78 communicates with the second reference shaft hole 74 (FIG. 3) and the contact portion 84 protrudes downward from the lower end of the sheet metal fixing wall 46.

With this configuration, as shown in FIG. 3, the bearing portion insertion hole 80 communicates with the first through hole 71, the first positioning hole 81 communicates with the second through hole 72, and the second positioning hole 82 communicates with the third through hole 73.

The second sheet metal member 68 is fixed to a rear surface of the rear wall 43 by screws 76 such that the reference shaft fixing hole 78 communicates with the first reference shaft hole 48 (FIG. 2) and the contact portion 84 overlaps with an upper portion of the engagement shaft hole 47.

With this configuration, the bearing portion insertion hole 80 communicates with the first opening 109, the first positioning hole 81 communicates with the second opening 110, and the second positioning hole 82 communicates with the third opening 111.

As shown in FIGS. 2 and 4, the reference shaft 85 (FIG. 2) and the belt unit 26 (FIG. 4) are held between the first sheet metal member 67 and the second sheet metal member 68.

Figure 7:
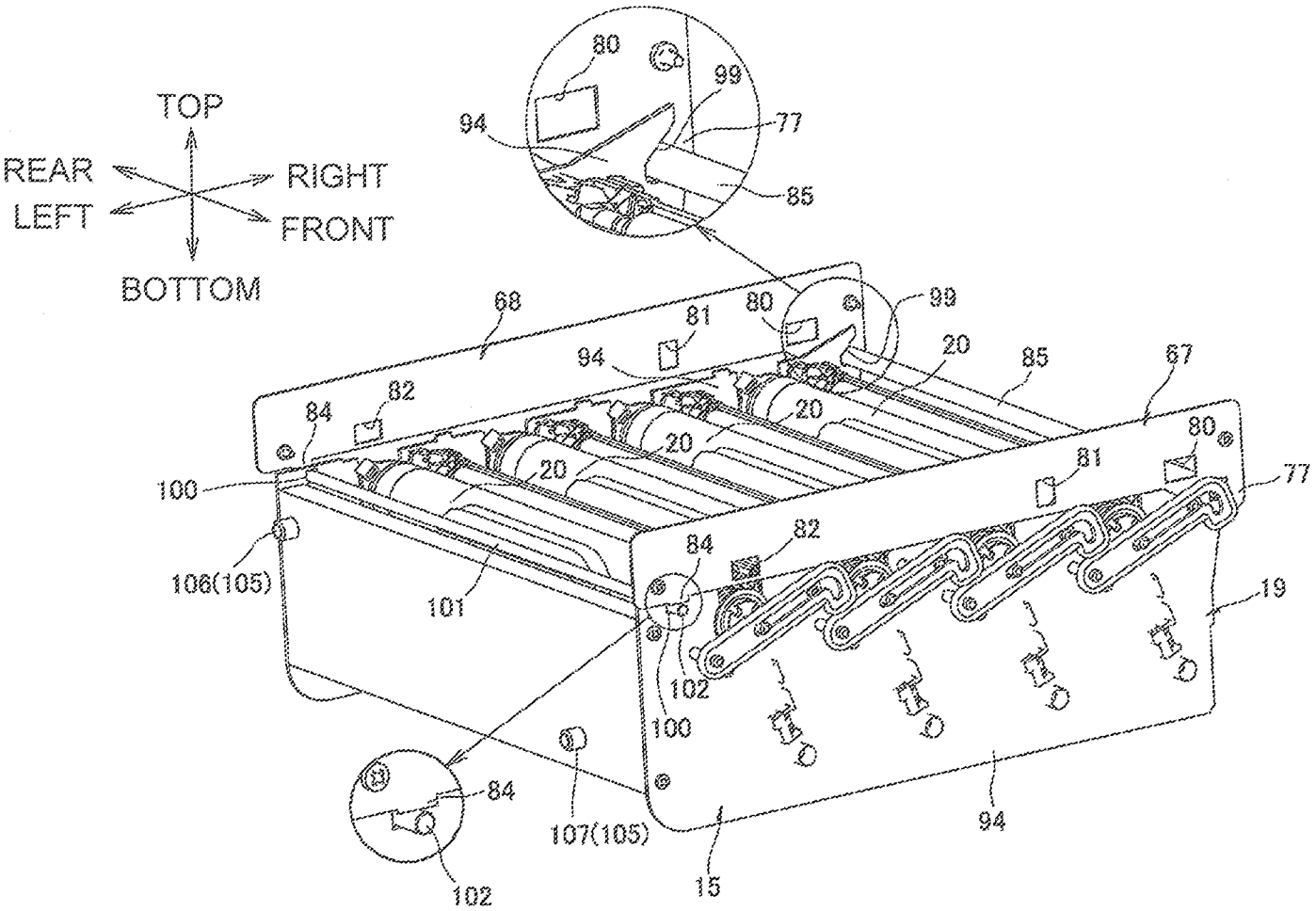
FIG. 7 is a perspective view, looking from the front and top, of the process unit, a first sheet metal member, and a second sheet metal member, illustrated in FIG. 2.

As shown in FIGS. 2, 3, and 7, the belt unit 26 is omitted for the sake of brevity.

As shown in FIG. 2, the reference shaft 85 extends in the front-rear direction and is shaped like a circular cylinder. A front end portion of the reference shaft 85 is inserted into the second reference shaft hole 74 of the sheet metal fixing wall 46 (FIG. 3), and a rear end portion of the reference shaft 85 is inserted into the first reference hole 48 of the rear wall 43 and the reference shaft fixing hole 78 of the second sheet metal member 68 (FIG. 3).

As the reference shaft 85 extends between the first sheet metal member 67 and the second sheet metal member 68 and has an outside diameter which is substantially equal to the top-bottom dimension and the left-right dimension of the reference shaft fixing hole 78, displacements of the reference shaft 85 relative to the first sheet metal member 67 and the second sheet metal member 68 in a top-bottom direction and the left-right direction are restricted.

As shown in FIG. 4, the belt unit 26 includes a pair of belt frames 90 disposed opposite to each other in the front-rear direction. In FIG. 4, the inside casing 41 is omitted for the sake of brevity.

Each of the belt frames 90 is shaped like a flat plate elongated in the left-right direction.

Each of the belt frames 90 includes the bearing portion 91, the first positioning protrusion 92, and the second positioning protrusion 93.

The bearing portion 91 is disposed at a right end portion of the belt frame 90 and is shaped like a cylinder extending outward from an outer surface of the belt frame 90 in the front-rear direction.

The first positioning protrusion 92 is disposed on the left side of the bearing portion 91, has substantially a rectangular shape, as viewed from the front side, and protrudes outward from the outer surface of the belt frame 90 in the front-rear direction.

The second positioning protrusion 93 is disposed on the left side of the first positioning protrusion 92, is substantially U-shaped as viewed from the front side, and protrudes outward from the outer surface of the belt frame 90 in the front-rear direction.

The drive roller 28, the driven roller 29, the intermediate transfer belt 30 and the four primary transfer rollers 31 are held between the belt frames 90.

The drive roller 28 is rotatably supported at its front end portion by the front-side bearing portion 91 and at its rear end portion by the rear-side bearing portion 91.

The belt unit 26 is disposed such that the belt frames 90 are sandwiched between the first sheet metal member 67 and the second sheet metal member 68 in the front-rear direction.

Thus, the front--side bearing portion 91 is inserted through the first through hole 71 (FIG. 3) into the bearing portion insertion hole 80 of the first sheet metal member 67 from the rear side, the front-side first positioning protrusion 92 is inserted through the second through hole 72 (FIG. 3) into the first positioning hole 81 of the first sheet metal member 67 from the rear side, and the front-side second positioning protrusion 93 is inserted through the third through hole 72 (FIG. 3) into the second positioning hole 82 of the first sheet metal member 67 from rear side.

The rear-side bearing portion 91 is inserted through the first opening 109 into the bearing portion insertion hole 80 of the second sheet metal member 68 from the front side, the rear-side first positioning protrusion 92 is inserted through the second opening 110 into the first positioning hole 81 of the second sheet metal member 68 from the front side, and the rear-side second positioning protrusion 93 is inserted through the third opening 111 into the second positioning hole 82 of the second sheet meal member 68 from the front side.

Thus, the belt unit 26 is positioned relative to the first sheet metal member 67 and the second sheet metal member 68.

As shown in FIG. 2, the process unit 15 includes a drawer frame 19 as an example of a holding unit.

The drawer frame 19 is configured to slide in the front-rear direction between an accommodation position where the drawer frame 19 is accommodated in the inside casing 41 (FIG. 1) and a withdrawal position where the drawer frame 19 is withdrawn from the inside casing 41 (FIG. 2), The drawer frame 19 is shaped like an open-topped rectangular box. The drawer frame 19 includes a pair of sidewalls 94 disposed opposite to and spaced apart from each other in the front-rear direction, and a left sidewall 95 extending between left end portions of the sidewalls 94.

Each of the sidewalls 94 is made of metal and shaped like a flat plate having a rectangular shape as viewed from the front side.

Each of the sidewalls 94 has an engagement groove portion 99 as an example of a second engaging portion and an engagement shaft support hole 100.

The engagement groove portion 99 is formed in an upper end portion of a right end portion of each sidewall 94, and is shaped like substantially a letter which is recessed leftward from the right end of the sidewall 94. In other words, the right end portion of the drawer frame 19 has two engagement groove portions 99 spaced apart from each other in the front-rear direction.

The engagement shaft support hole 100 is formed in an upper end portion of a left end portion of each sidewall 94, and is shaped like a rectangle as viewed from the front side. The engagement shaft support hole 100 has a top-bottom dimension and a left-right dimension which are substantially equal to an outside diameter of the engagement shaft 101.

The engagement shaft 101 is disposed between the sidewalls 94.

The engagement shaft 101 extends in the front-rear direction and is shaped like a circular cylinder. The engagement shaft 101 has a front-rear dimension which is longer than a distance between the sidewalls 94.

The front and rear end portions of the engagement shaft 101 are inserted into the engagement shaft support holes 100 of the sidewalls 94, and the engagement shaft 101 is supported by the sidewalls 94. As the engagement shaft 101 has an outside diameter which is substantially equal to the top-bottom dimension and the left-right dimension of the engagement shaft support hole 100, displacements of the engagement shaft 101 relative to the sidewalls 94 in the top-bottom direction and the left-right direction are restricted.

The front and rear end portions of the engagement shaft 101 protrudes outward from the respective side-walls 94 in the front-rear direction, and function as contact portions 102 as an example of a first engaging portion. In other words, the contact portions 102 are disposed in front and rear end portions, respectively, of a left end portion of the drawer frame 19.

The left sidewall 95 is shaped like a flat plate having substantially a rectangular shape. The left sidewall 95 has, on its left surface, guide bosses 105 as an example of a guided portion.

The guide bosses 105 include an upper guide boss 106 corresponding to the upper guide portion 51 and a lower guide boss 107 corresponding to the lower guide portion 52.

The upper guide boss 106 is disposed in an upper portion of a rear end portion of the left sidewall 95 as shown in FIG. 6, and is shaped like a cylinder protruding leftward from the left surface of the left sidewall 95 as shown in FIG. 2.

The lower guide boss 107 is disposed in a front side portion of a lower portion of the left sidewall 95 as shown in FIG. 6, and is shaped like a cylinder protruding leftward from the left surface of the left sidewall 95 as shown in FIG. 2.

The drawer frame 19 integrally holds the four photosensitive drums 20, the four scorotron chargers 21 (FIG. 1), the four developing units 22 (FIG. 1), and the four LED units 16 (FIG. 1).

Front and rear end portions of the photosensitive drums 20 are supported by the sidewalls 94 such that the photosensitive drums 20 are rotatable and their upper portions are exposed from above. Thus, the photosensitive drums 20 are positioned relative to the sidewalls 94.

Front and rear end portions of the scorotron chargers 21 (FIG. 1), the developing units 22 (FIG. 1), and the LED units 16 (FIG. 1) are fixed to the sidewalls 94 such that they extend in the front-rear direction.

Next, the following will describe attachment or removal of the process unit 15 relative to the inside casing 41.

When the process unit 15 is attached to the inside casing 41, as shown in FIG. 2, the process unit 15 is located in front of the opening 3.

Then, the process unit 15 is moved rearward and inserted into the inside casing 41 from the rear end portion.

The upper guide boss 106 of the drawer frame 19 is guided by the upper surface of the horizontal portion 53 of the upper guide portion 51, and the process unit 15 is inserted rearward into the inside casing 41 along the front-rear direction.

When the process unit 15 is moved rearward relative to the inside casing 41 until the upper guide boss 106 reaches the rear end portion of the horizontal portion 53, the lower guide boss 107 reaches the front end portion of the inclined portion 56 of the lower guide portion 52.

When the process unit 15 is pressed further rearward into the inside casing 41, the upper guide boss 106 is guided by the upper surface of the inclined portion 54 of the upper guide portion 51, and the lower guide boss 107 is guided by the upper surface of the inclined portion 56 of the lower guide portion 52.

Thus, the process unit 15 or drawer frame 19 is moved rearward and upward by the inclined portion 54 of the upper guide portion 51 and the inclined portion 56 of the lower guide portion 52.

Then, the upper guide boss 106 reaches the front end portion of the upper pivotable portion 60 of the upper pressing portion 59, and the lower guide boss 107 reaches the front end portion of the lower pivotable portion 62 of the lower pressing portion 66 (FIG. 6).

When the process unit 15 is pressed further into the inside casing 41, the upper guide boss 106 is guided by the upper pivotable portion 60, the lower guide boss 107 is guided by the lower pivotable portion 62, and the process unit 15 or drawer frame 19 is moved rearward and upward.

At this time, the rear end portion of the engagement shaft 101 is freely fit in the engagement shaft hole 47 of the rear wall 43 (FIG. 3) from the front side.

Thus, the drawer frame 19 is located in the accommodation position where it is accommodated in the inside casing 41.

At this time, as shown in FIG. 6, the upper guide boss 106 is pressed in the upper front direction (or a pressing direction X) by the coil spring 61 via the upper pivotable portion 60, while the lower guide boss 107 is pressed in the upper front direction (or a pressing direction Y) by the coil spring 63 via the lower pivotable portion 62.

As shown in FIG. 5B, the first pressing member 50 is moved from the withdrawal position to the advance position, and presses the left sidewall 95 of the drawer frame 19.

Then as shown in FIG. 5A, the drawer frame 19 is moved leftward and upward. In other words, the drawer frame 19 is pressed toward the first sheet metal member 67 and the second sheet metal member 68 by the first pressing member 50 and the second pressing member 58 (the upper pressing portion 59 and the lower pressing portion 66). Thus, the photosensitive drums 20 supported by the drawer frame 19 are also pressed toward the first sheet metal member 67 and the second sheet metal member 68 by the first pressing member 50 and the second pressing member 58.

At this time, the engagement groove portion 99 of the front-side sidewall 94 receives and contacts (or engages) the front end portion of the reference shaft 85 from an upper left side and from below, while the engagement groove portion 99 of the rear-side sidewall 94 receives and contacts (or engages) the rear end portion of the reference shaft 85 from an upper left side and from below.

The front-side contact portion 102 of the engagement shaft 101 contacts (or engages) the contact portion 84 of the first sheet metal member 67 from below, while the rear-side contact portion 102 of the engagement shaft 101 contacts (or engages) the contact portion 84 of the second sheet metal member 68.

Thus, the drawer frame 19 is positioned relative to the first sheet metal member 67 and the second sheet metal member 68, and the four photosensitive drums 20 are positioned via the drawer frame 19 relative to the first sheet metal member 67 and the second sheet metal member 68.

As described above, the process unit 15 is attached to the inside casing 41.

At this time, as shown in FIG. 5A, the rear wall 43 is disposed on the rear side of the four photosensitive drums 20, the left wall 44 is disposed on the left side of the leftmost photosensitive drum 20, and the upper wall 45 is disposed above the four photosensitive drums 20.

The sheet metal fixing wall 46 is disposed on the front side of the four photosensitive drums 20.

To withdraw the process unit 15 from the inside casing 41, the above attachment procedure is reversed.

Specifically, the process unit 15 is withdrawn toward the front side relative to the inside casing 41.

As shown in FIG. 6, the upper guide boss 106 is guided by the upper pivotable portion 60, the lower guide boss 107 is guided by the lower pivotable portion 62, and the process unit 15 (or the drawer frame 19) is moved frontward and downward.

When the process unit 15 is withdrawn further frontward from the inside casing 41, the upper guide boss 106 is guided by the upper surface of the inclined portion 54 of the upper guide portion 51, and the lower guide boss 107 is guided by the upper surface of the inclined portion 56 of the lower guide portion 52.

The inclined portion 54 of the upper guide portion 51 continues from a downstream end portion of the upper pivotable portion 60 in a withdrawal direction of the process unit 15, and the inclined portion 56 of the lower guide portion 52 continues from a downstream end portion of the lower pivotable portion 62 in the withdraw direction.

Thus, the process unit 15 (or the drawer frame 19) is moved frontward and downward by the inclined portion 54 of the upper guide portion 51 and the inclined portion 56 of the lower guide portion 52.

Then, the upper guide boss 106 is guided by the upper surface of the horizontal portion 53 of the upper guide portion 51, and the process unit 15 is withdrawn frontward through the opening 3 from the inside casing 41 along the front-rear direction.

In this manner, the drawer frame 19 is located in the withdrawal position where it is withdrawn from the inside casing 41, and this completes withdrawal of the process unit 15 from the inside casing 41.

According to the printer 1, as shown in FIG. 2, the four photosensitive drums 20 are configured to be withdrawn relative to the inside casing 41 along the front-rear direction (or an axial direction of the photosensitive drums 20).

As the inside casing 41 includes the rear wall 43, the left wall 44, and the upper wall 45 integrally, it possesses adequate structural strength.

As the rear wall 43, the left wall 44 and the upper wall 45 are integrally formed of resin, the reductions of the material cost and the weight of the printer 1 can be achieved.

When attached to or accommodated in the inside casing 41, the four photosensitive drums 20 are pressed toward the first sheet metal member 67 by the first pressing member 50 and the second pressing member 58 (the upper pressing portion 59 and the lower pressing portion 66) via the drawer frame 19 and thus positioned relative to the first sheet metal member 67.

Thus, the four respective photosensitive drums 20 are precisely positioned relative to the inside casing 41, and thus the positional relationship of the photosensitive drums 20 relative to the inside casing 41 remains invariant.

As a result, the structural strength of the inside casing 41 can be improved, the four photosensitive drums 20 can be withdrawn relative to the inside casing 21 along the axial direction of the photosensitive drums 20, the reductions of the material cost and the weight of the printer 1 can be achieved, and the positional relationship of the photosensitive drums 20 relative to the inside casing 41 can be maintained.

The rear wall 43 includes the second sheet metal member 68 disposed opposite to and away from the first sheet metal member 67 in the front-rear direction (or the axial direction of the photosensitive drums 20).

Thus, the structural strength of the inside casing 41 can be improved.

As a result, an improvement in the positional accuracy of the photosensitive drums 20, which are positioned relative to the first sheet metal member 67, with respect to the inside casing 41 can be obtained.

The inside casing 41 includes the sheet metal fixing wall 46, which is disposed on the front side of the photosensitive drum 20 (or disposed on one side in the axial direction of the photosensitive drums 20) and made of resin. The first sheet metal member 67 is fixed to the front surface of the sheet metal fixing wall 46, and the second sheet metal member 68 is fixed to a rear surface of the rear wall 43.

Thus, with a simple structure,the first sheet metal member 67 can be fixed to the inside casing 41 reliably.

As a result, the positional accuracy of the photosensitive drums 20, which are positioned relative to the first sheet metal member 67, with respect to the inside easing 41 can be obtained.

The first sheet metal member 67 and the second sheet metal member 68 can be attached to the inside casing 41 from outside.

Thus, the first sheet metal member 67 and the second sheet metal member 68 can be attached to the inside casing 41 with efficiency.

The reference shah 85 extends between the right end portions of the first sheet metal member 67 and the second sheet metal member 68.

Thus, with a simple structure, an improvement in the structural strength of the inside casing 41 can be obtained, The process unit 15 includes the drawer frame 19.

The drawer flame 19 is configured to integrally hold the four photosensitive drums 20 and slide in the front-rear direction (or the axial direction of the photosensitive drums 20) between the accommodation position (FIG. 1) where the drawer frame 19 is accommodated in the inside casing 41 and the withdrawal position (FIG. 2) where the drawer frame 19 is withdrawn from the inside casing 41.

Thus, the four photosensitive drums 20 can be collectively withdrawn from the inside casing 41 by withdrawing the drawer frame 19 from the inside casing 41 toward the front side in the axial direction of the photosensitive drums 20.

Thus, an improvement in the maintenance of the photosensitive drums 20 can be obtained.

The drawer frame 19 includes the front and rear sidewalls 94 which are paired. The sidewalls 94 support the engagement shaft 101 at their upper left end portions. Both ends of the engagement shaft 101 in the front-rear direction protrude outward from the respective sidewalls 94 in the front-rear direction and are formed as the contact portions 102.

The sidewalls 94 have the engagement groove portions 99 at their upper right end portions respectively.

As shown in FIG. 5A, when the drawer frame 19 is located in the accommodation position, the contact portions 102 engage the contact portions 84 of the first sheet metal member 67 and the second sheet metal member 68 respectively, and the engagement groove portions 99 engage the reference shaft 85. Thus, the drawer frame 19 is positioned accurately relative to the inside casing 41.

As a result, an improvement in positioning accuracy of the photosensitive drums 20 held by the drawer frame 19 relative to the inside casing 41 can be obtained.

Thus, an improvement in the maintenance of the photosensitive drums 20 can be obtained, and an improvement in the positioning accuracy of the photosensitive drums 20 relative to the inside casing 41 can be obtained.

The contact portions 102 are disposed in the front and rear end portions of the right end portion of the drawer frame 19.

The engagement groove portions 99 are formed in the front and rear end portions of the right end portion of the drawer frame 19.

Thus, when the drawer frame 19 is located in the accommodation position, the front and rear end portions of the left end portion of the drawer frame 19 are positioned relative to the first sheet metal member 67 and the second sheet metal member 68 via the contact portions 102, and the front and rear end portions of the right end portion of the drawer frame 19 are positioned relative to the reference shaft 85 via the engagement shaft 99. In other words, each end portion of the drawer frame 19 (or four corners of the drawer flame 19 in a plan view) is positioned accurately relative to the inside casing 41.

Thus, a further improvement in the positioning accuracy of the photosensitive drums 20 held by the drawer frame 19 relative to the inside casing 41 can be obtained.

The contact portions 102 protrude outward in the front-rear direction from the respective sidewalls 94 (or protrude outward in the axial direction of the photosensitive drums 20), and the engagement groove portions 99 are recessed from the right ends of the sidewalls 94 to the left side (inward in the arrangement direction of the photosensitive drums 20).

Thus, with a simple structure, the contact portions 102 can engage the contact portions 84 of the first sheet metal member 67 and the second sheet metal member 68 reliably, and the engagement groove portions 99 can engage the reference shaft 85 reliably.

As shown in FIG. 6, when the drawer frame 19 is withdrawn from the inside casing 41, the upper guide boss 106 of the drawer frame 19 is guided by the upper pivotable portion 60 and then by the inclined portion 54, and the lower guide boss 106 of the drawer frame 19 is guided by the lower pivotable portion 62 and then by the inclined portion 56.

Thus, the drawer frame 19 can be smoothly withdrawn from the inside casing 41.

As shown in FIG. 3, the inside casing 41 includes the reinforcing portion 83 trade of metal. The reinforcing portion 83 includes the first reinforcing member 86 extending frontward from the right end portion of the lower end of the rear wall 43, the second reinforcing member 87 extending rightward from the front end portion of the lower end of the left wall 44, and the third reinforcing member 88 extending downward from the L-shaped portion, as viewed from the top, formed by the front end portion of the right end of the upper wall 45 and the right end portion of the front end of the upper wall 45. The front end portion of the first reinforcing member 86, the right end portion of the second reinforcing member 87, and the lower end portion of the third reinforcing member 88 are coupled to each other. Thus, the inside casing 41 is reinforced.

Thus, with a, simple structure, an improvement in the structural strength of the inside casino 41 can be obtained.

As shown in FIG. 1, the printer 1 includes the belt unit 26, which is disposed above the four photosensitive drums 20 and opposite to the four photosensitive drums 20 vertically, and the developing units 22, which are disposed under the photosensitive drums 20 respectively and configured to supply toner to the respective photosensitive drums 20.

Thus, toner can be supplied to each of the photosensitive drums 20 reliably.

The belt unit 26 includes the intermediate transfer belt 30, which is disposed above the photosensitive drums 20 along the left-right direction (or the arrangement direction of the photosensitive drums 20), and the four primary transfer rollers 31, which are disposed opposite to the respective photosensitive drums 20 in the top-bottom direction (vertically) with the intermediate transfer belt 30 interposed therebetween.

The printer 1 further includes the secondary transfer roller 27 which is disposed opposite to the right end portion of the intermediate transfer belt 30.

Thus, the printer 1 can transfer toner images onto a sheet P without the need to pass the sheet P between the photosensitive drums 20 and the belt unit 26, compared with a direct-tandem type printer where toner images carried on the respective photosensitive drums are directly transferred onto a sheet P.

As a result, the sheet conveyance path can be simplified.

As shown in FIG. 4, the belt unit 26 is positioned relative to the first sheet metal member 67.

In other words, the photosensitive drums 20 and the belt unit 26 are positioned relative to the first sheet metal member 67.

As a result, an improvement in the relative positioning accuracy of the photosensitive drums 20 and the belt unit 26 can be obtained.

The printer 1 further includes the LED units 16 configured to expose the respective photosensitive drums 20.

Thus, the photosensitive drums 20 can be exposed by the LED units 16 whose size is small compared with a scanner which emits laser beams to expose the photosensitive drums 20. Thus, the need to increase the physical size of the printer 1 can be obviated.

A second embodiment will be described.

Figure 8:
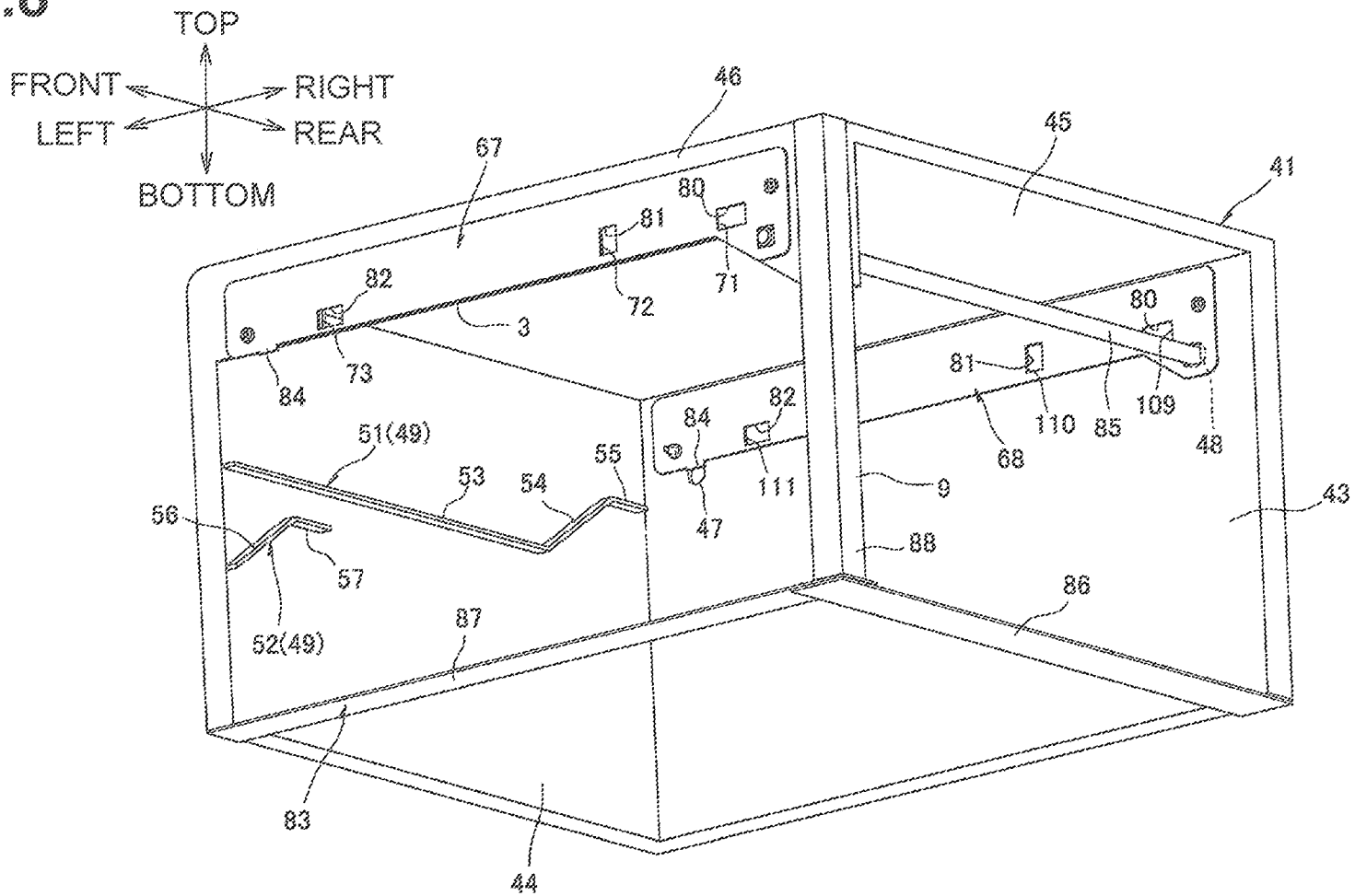
FIG. 8 is a perspective view, looking from the bottom and re of an inside casing of a printer according to a second embodiment of the disclosure.

FIG. 8 is a perspective view illustrating an inside casing of a printer according to the second embodiment of the disclosure.

It is noted that throughout FIGS. 1 to 7 elements similar to or identical with those shown in and described with reference to FIG. 8 are designated by similar numerals, and thus the description thereof can be omitted for the sake of brevity.

In the first embodiment, as shown in FIG. 3, the second sheet metal member 68 is disposed on the rear surface of the rear wall 43. In the second embodiment, as shown in FIG. 8, the second sheet metal member 68 is disposed on a front surface of the rear wall 43 for an inside surface in the axial direction of the photosensitive drums 20).

Thus, even with the second embodiment, it is clear that effects similar to those brought about by the first embodiment can be appreciated.

As the second sheet metal member 68 is fittingly accommodated in the inside casing 41, a space in the inside casing 41 can be effectively used, and the need to increase the physical size of the printer I can be obviated.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a process unit including a plurality of photosensitive drums and a holding unit holding the plurality of photosensitive drums, the plurality of photosensitive drums being spaced apart from each other and arranged such that axes of the photosensitive drums are parallel relative to each other in an arrangement direction perpendicular to an axial direction of the photosensitive drums;

a frame member configured to accommodate the process unit such that the process unit is inserted into and withdrawn from the frame member along the axial direction; the frame member including:

a first sheet metal member disposed on a first side of the frame member, a second sheet metal member disposed on a second side of the frame member spaced apart from and facing the first sheet metal member in the axial direction;

a first wall disposed on the second side of the frame member;

a second wall disposed on a third side of the frame member, the third side connecting the first side and the second side, the second wall being connected to the first wall; and a third wall disposed on an upper side relative to the photosensitive drum, the third wall being connected to the first wall and the second wall; and a pressing member configured to press the process unit such that the pressing member moves in a direction diagonally upwardly toward the first sheet metal member and inwardly away from the second wall, wherein the frame member has an opening below the first sheet metal member and the process unit including the plurality of photosensitive drums is configured to be inserted into and removed from the frame member through the opening below the first sheet metal member along the axial direction, and wherein a lower end of the first sheet metal member includes a contact portion configured to, when the process unit is accommodated in the frame member, contact the process unit to position the plurality of photosensitive drums included in the process unit relative to the frame member.

2. The image forming apparatus according to claim 1, wherein the first wall, the second wall, and the third wall are integrally made of resin.

3. The image forming apparatus according to claim 1, wherein the frame member includes a resin-made frame, which is made of resin and disposed on the first side of the frame member, the first sheet metal member is fixed to an outer surface of the resin-made frame in the axial direction, and the second sheet metal member is fixed to an outer surface of the first wall in the axial direction.

4. The image forming apparatus according to claim 1, wherein the frame member includes a resin-made frame, which is made of resin and disposed on the first side of the frame member, the first sheet metal member is fixed to an outer surface of the resin-made frame in the axial direction, and the second sheet metal member is fixed to an inner surface of the first wall in the axial direction.

5. The image forming apparatus according to claim 1, further comprising a reference shaft extending in the axial direction between the first sheet metal member and the second sheet metal member.

6. The image forming apparatus according to claim 5, wherein the holding unit includes a first engagement portion configured to, when the process unit is accommodated in the frame member, engage the contact portion of the first sheet metal member and the second sheet metal member, and a second engagement portion configured to, when the process unit is accommodated in the frame member, engage the reference shaft.

7. The image forming apparatus according to claim 6, wherein the first engagement portion is disposed at each end portion in the axial direction in a first end portion of the holding unit in the arrangement direction, and the second engagement portion is disposed at each end portion in the axial direction in a second end portion, opposite to the first end portion, of the holding unit in the arrangement direction.

8. The image forming apparatus according to claim 6, wherein the first engagement portion includes a protrusion protruding outward from the holding unit in the axial direction, and the second engagement portion includes a groove portion recessed inward from the holding unit in the arrangement direction.

9. The image forming apparatus according to claim 1, wherein the frame member includes a first guide portion and a second guide portion connected to a downstream end portion of the first guide portion in a direction where the holding unit is inserted into the frame member, the first guide portion is configured to move the holding unit in the axial direction, and the second guide portion is configured to guide the holding unit in the axial direction and vertically, and wherein the holding unit includes a guided portion to be guided by the first guide portion and the second guide portion and to contact the first guide portion and the second guide portion from above.

10. The image forming apparatus according to claim 1, wherein the frame member includes:

a first reinforcing member made of metal and extending from the first wall toward the first side in the axial direction;

a second reinforcing member made of metal and extending from the second wall toward a fourth side opposite to the third side in the arrangement direction; and a third reinforcing member made of metal and extending downward from the third wall, and wherein the first reinforcing member, the second reinforcing member and the third reinforcing member are coupled to each other.

11. The image forming apparatus according to claim 1, further comprising a belt unit disposed above the process unit accommodated in the frame member;

wherein the holding unit is configured to hold a plurality of developing units below the photosensitive drums respectively, each of the developing units being configured to supply a developer to a corresponding one of the photosensitive drums.

12. The image forming apparatus according to claim 11, wherein the belt unit includes:

an intermediate transfer belt disposed above the photosensitive drums along the arrangement direction;

a plurality of primary transfer rollers disposed facing the photosensitive drums respectively vertically with the intermediate transfer belt interposed between the primary transfer rollers and the photosensitive drums; and a secondary transfer roller disposed opposite to an end portion of the intermediate transfer belt in the arrangement direction.

13. The image forming apparatus according to claim 11, wherein the belt unit is positioned relative to the first sheet metal member.

14. The image forming apparatus according to claim 1, further comprising a plurality of LED units each configured to expose a corresponding one of the photosensitive drums.

15. The image forming apparatus according to claim 1, wherein the contact portion of the first sheet metal member protrudes downward from the lower end of the first sheet metal member, and the process unit includes a contact portion configured to, when the process unit is accommodated in the frame member, contact the contact portion of the first sheet metal member from below.

16. The image forming apparatus according to claim 15, wherein the holding unit of the process unit includes the contact portion.

* * * * *